US008118718B2

(12) United States Patent
Brodess et al.

(10) Patent No.: US 8,118,718 B2
(45) Date of Patent: Feb. 21, 2012

(54) ABDOMINAL EXERCISE TRAINING DEVICE

(75) Inventors: David Brodess, Austin, TX (US); Michael Casey, Austin, TX (US)

(73) Assignee: Fitness Brands 2, LLC, Austin, TX (US)

( * ) Notice: Subject to any disclaimer, the term of this patent is extended or adjusted under 35 U.S.C. 154(b) by 103 days.

(21) Appl. No.: 12/775,964

(22) Filed: May 7, 2010

(65) Prior Publication Data

US 2011/0275498 A1 Nov. 10, 2011

(51) Int. Cl.
*A63B 21/00* (2006.01)

(52) U.S. Cl. ..... 482/123; 482/132; 482/135; 482/907

(58) Field of Classification Search ..... 482/123, 482/132, 907, 130, 126, 101, 121
See application file for complete search history.

(56) References Cited

U.S. PATENT DOCUMENTS

| | | | | |
|---|---|---|---|---|
| 1,984,165 | A * | 12/1934 | Tolchin | 482/95 |
| 4,989,860 | A * | 2/1991 | Iams et al. | 482/132 |
| 5,518,483 | A * | 5/1996 | Oswald | 482/131 |
| 6,071,217 | A | 6/2000 | Barnett | |
| D439,291 | S | 3/2001 | Barnett et al. | |

* cited by examiner

*Primary Examiner* — Jerome w Donnelly
(74) *Attorney, Agent, or Firm* — TechLaw LLP

(57) ABSTRACT

An abdominal training device includes a stationary base with a user support surface and a hub connected to a track with a friction mitigation unit and a track anchor. A console is slidably mounted on the track and includes a hand support member and a console anchor. A bearing is fixedly mounted to the proximal end of the track and supports an elastic resistance element with one end attached to the track anchor and the other end attached to the console anchor. A beam rigidly connects the track to the hub of the stationary base so that the track is at least partially rotatable about the hub of the stationary base. The device may also include an electronic training program that directs a user to rotate the track to specified positions. The device may be part of an abdominal training kit.

23 Claims, 11 Drawing Sheets

ABDOMINAL EXERCISE TRAINING DEVICE

FIELD

The following description relates generally to exercise equipment, and more particularly to an abdominal exercise training device.

BACKGROUND

Fitness experts and athletes are becoming increasingly aware of the importance of a strong "core" to overall fitness and athletic ability. Among the most important core muscles are muscles in the stomach, chest and back, in particular the abdominal muscles. Abdominal and other core muscles can be exercised without the use of any exercise equipment, for example by doing abdominal crunches or sit-ups. However, performing these exercises poses risk of injury, especially to the lower back, if the person does not use proper technique and/or is not in good physical shape. It is therefore desirable to provide a piece of fitness equipment that allows people to exercise their core muscles safely using consistent form.

Many such devices are well known. For example, there are many devices used for performing abdominal crunches and sit-ups. Furthermore, devices for exercising core muscles using motions not possible without special equipment are known. For example, U.S. Pat. No. 6,071,217 to Barnett discloses a prone torso exerciser. However, these known devices lack functionality and features that would improve the user's exercise experience. For example, known devices generally only target one group of muscles or only allow the user to move through one or two rigidly defined ranges of motion. Additionally, known devices do not generally provide any feedback or instructions to the user. The combination of repetitive exercises and lack of device interactivity (e.g., capability of the device to instruct the user on routines to perform and respond to user input and/or movements) can quickly lead to monotonous exercise routines that users quickly abandon out of boredom.

Accordingly, there is a need for an interactive exercise device that allows users to safely perform exercises using proper form without being constrained by the device to a narrow range of motion.

SUMMARY

The following simplified summary of devices that satisfy this need is provided in order to give a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of the disclosed embodiments, an abdominal training device includes a stationary base with a user support surface and a hub connected to a track with a friction mitigation unit and a distal end with a track anchor. A console is slidably mounted on the track and includes a hand support member and a console anchor. A bearing is fixedly mounted to the proximal end of the track and supports an elastic resistance element with one end attached to the track anchor and the other end attached to the console anchor. A beam rigidly connects the track to the hub of the stationary base so that the track is at least partially rotatable about the hub of the stationary base. The device may also include an electronic training program that directs a user to rotate the track to specified positions. The device may be part of an abdominal training kit that also includes a rotation measurement device comprising a plurality of evenly spaced indicators disposed around the hub of the abdominal training device, the plurality of evenly spaced indicators defining an arc.

In some embodiments, the bearing mounted to the proximal end of the track is a pulley that rollably supports one or more elastic resistance elements, each of which has a first end anchored to the distal end of the track and a second end anchored to the console. In some embodiments the hand support member of the console is a pair of handlebars, and the friction mitigation unit of the track is a wheel. The track may have a range of rotation about the hub of the stationary base of at least 90 degrees. Furthermore, the abdominal training device may include a track position sensor that detects a current displacement of the track relative to a starting position. An alert system may indicate the current displacement of the track to a user, for example using lights that illuminate or extinguish, or a sound generator that emits sound, when the current displacement of the track exceeds a threshold displacement. The abdominal training device may also have a console position sensor that detects a current position of the console relative to the track.

In some embodiments, the console of the abdominal training device includes an embedded electronic training program that uses data received from a track position sensor to direct a user to rotate the track from a current position to a new position. The new position of the track may be indicated to the user by illumination of a light corresponding to the new position to which the user is required to rotate the track. Once the user successfully rotates the track to the new position, the light corresponding to the new position is extinguished, or the user is otherwise notified, for example by sound emissions from a sound generator.

In another aspect of the disclosed embodiments, an abdominal training kit includes an abdominal training device and a rotation measurement device. The abdominal training device includes a stationary base with a user support surface and a hub. A track with a friction mitigation unit is rotatably connected to the hub of the stationary base. A console with a hand support member is slidably mounted on the track. A beam rigidly connects the track to the hub of the stationary base, the beam having a first end attached to the proximal end of the track and a second end attached to the hub of the stationary base so that the track is at least partially rotatable about the hub of the stationary base. The rotation measurement device includes a plurality of evenly spaced indicators disposed around the hub of the abdominal training device so as to define an arc about the hub. The arc defined by the plurality of evenly spaced indicators may be at least 45 degrees. The rotation measurement device may be an arcuate mat having a plurality of evenly spaced indicia. Additionally or alternatively, the plurality of evenly spaced indicators may be a plurality of evenly spaced cones.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

In one aspect of the disclosed embodiments, an abdominal training device includes a track that can be rotated around a hub of a stationary base. A console is slidably mounted on the track and includes a hand support member. A bearing mounted to the track supports an elastic resistance element with one end anchored to the track and the other end anchored to the console. Movement of the console along the track is resisted in one direction by the elastic resistance element. The device may also include an electronic training program that directs a user to rotate the track to specified positions. The device may be part of an abdominal training kit that also includes a rotation measurement system.

In another aspect of the disclosed embodiments, an abdominal training kit includes an abdominal training device and a rotation measurement device. The abdominal training device includes a stationary base with a user support surface and a hub. A track with a friction mitigation unit is rotatably connected to the hub of the stationary base. A console with a hand support member is slidably mounted on the track. A beam rigidly connects the track to the hub of the stationary base, the beam having a first end attached to the proximal end of the track and a second end attached to the hub of the stationary base so that the track is at least partially rotatable about the hub of the stationary base. The rotation measurement device includes a plurality of evenly spaced indicators disposed around the hub of the abdominal training device so as to define an arc about the hub. The arc defined by the plurality of evenly spaced indicators may be at least 45 degrees. The rotation measurement device may be an arcuate mat having a plurality of evenly spaced indicia. Additionally or alternatively, the plurality of evenly spaced indicators may be a plurality of evenly spaced cones.

Figure 1:
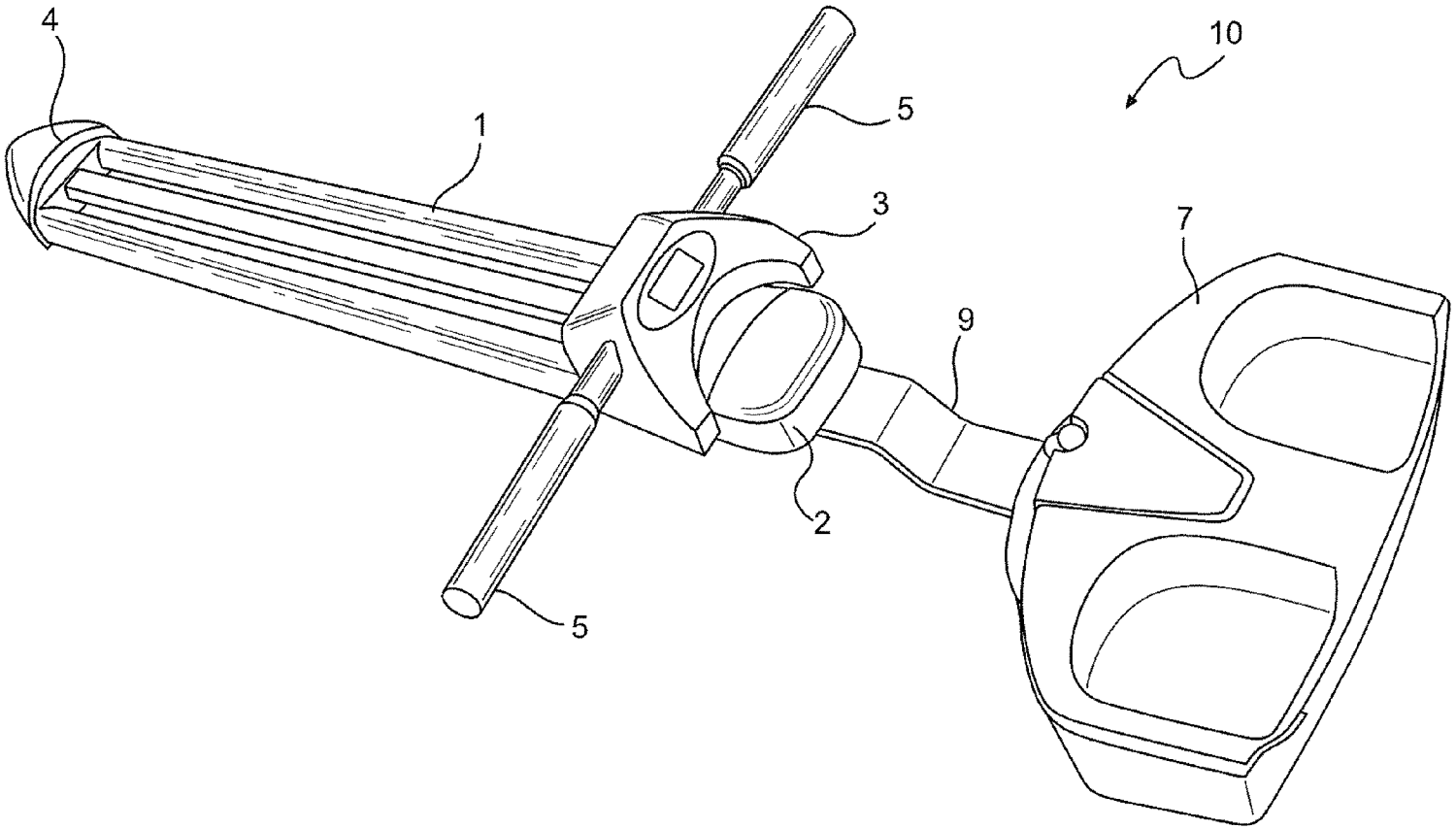
FIG. 1 is a perspective view of a first embodiment of an abdominal training device.
Figure 2:
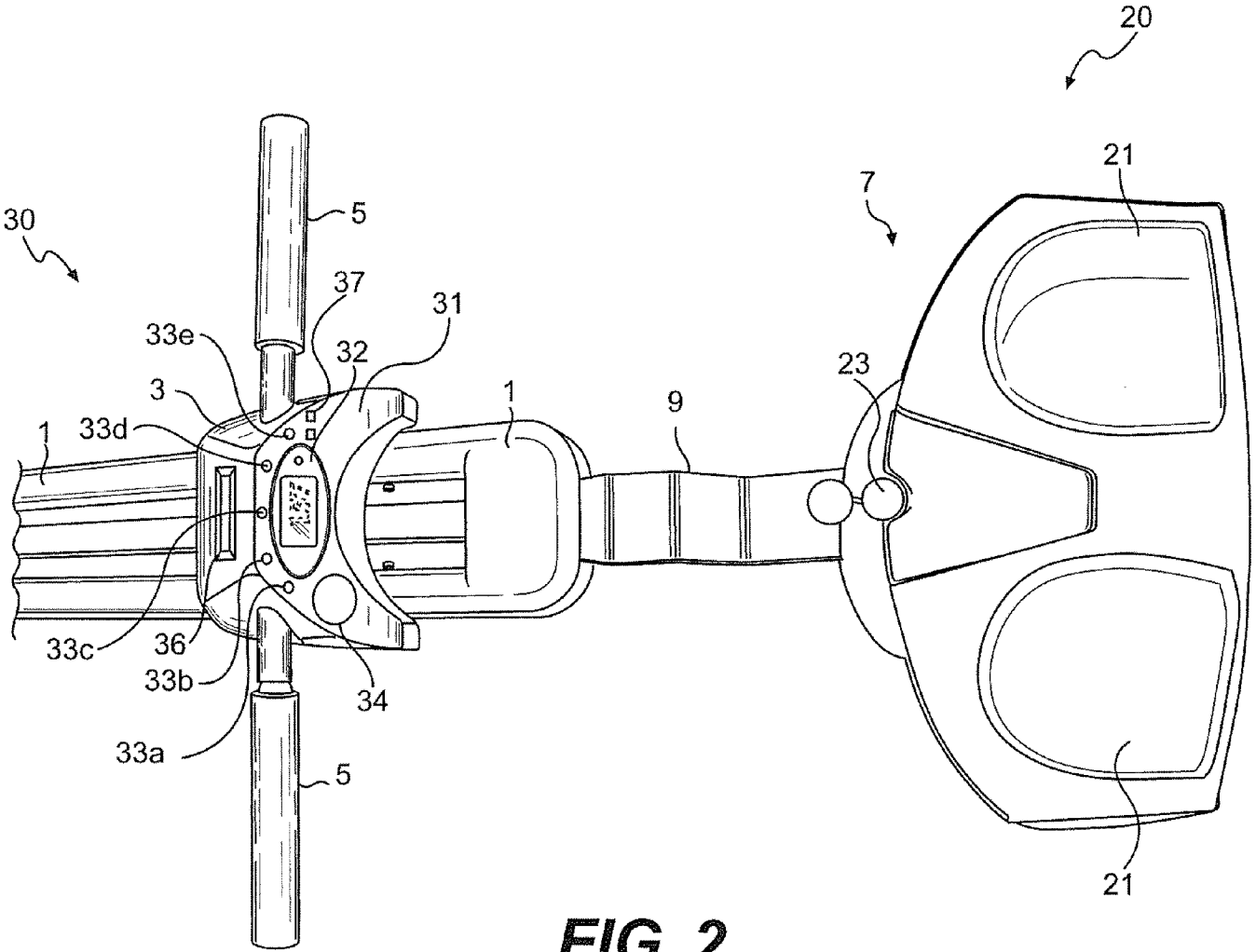
FIG. 2 is a partial top plan view of the embodiment of FIG. 1.

As seen in FIGS. 1 and 2, one embodiment of abdominal training device 10 includes track 1, console 3 and stationary base 7. Console 3 is slidably mounted on track 1 and includes hand support members 5 and user interface 31. User interface 31 may be on a removable panel that docks with console 3 so that user interface 31 is an optional feature. Track 1 includes proximal end 2 and distal end 4. Beam 9 rigidly connects proximal end 2 of track 1 to stationary base 7. The connection between beam 9 and stationary base 7 is a rotating connection (explained in further detail below) that allows track 1 to rotate in a horizontal plane at least partially around stationary base 7. Locking mechanism 23 may be engaged to prevent rotation of track 1. Stationary base 7 includes one or more user support surfaces 21 which may be formed as kneepads.

Figure 3:
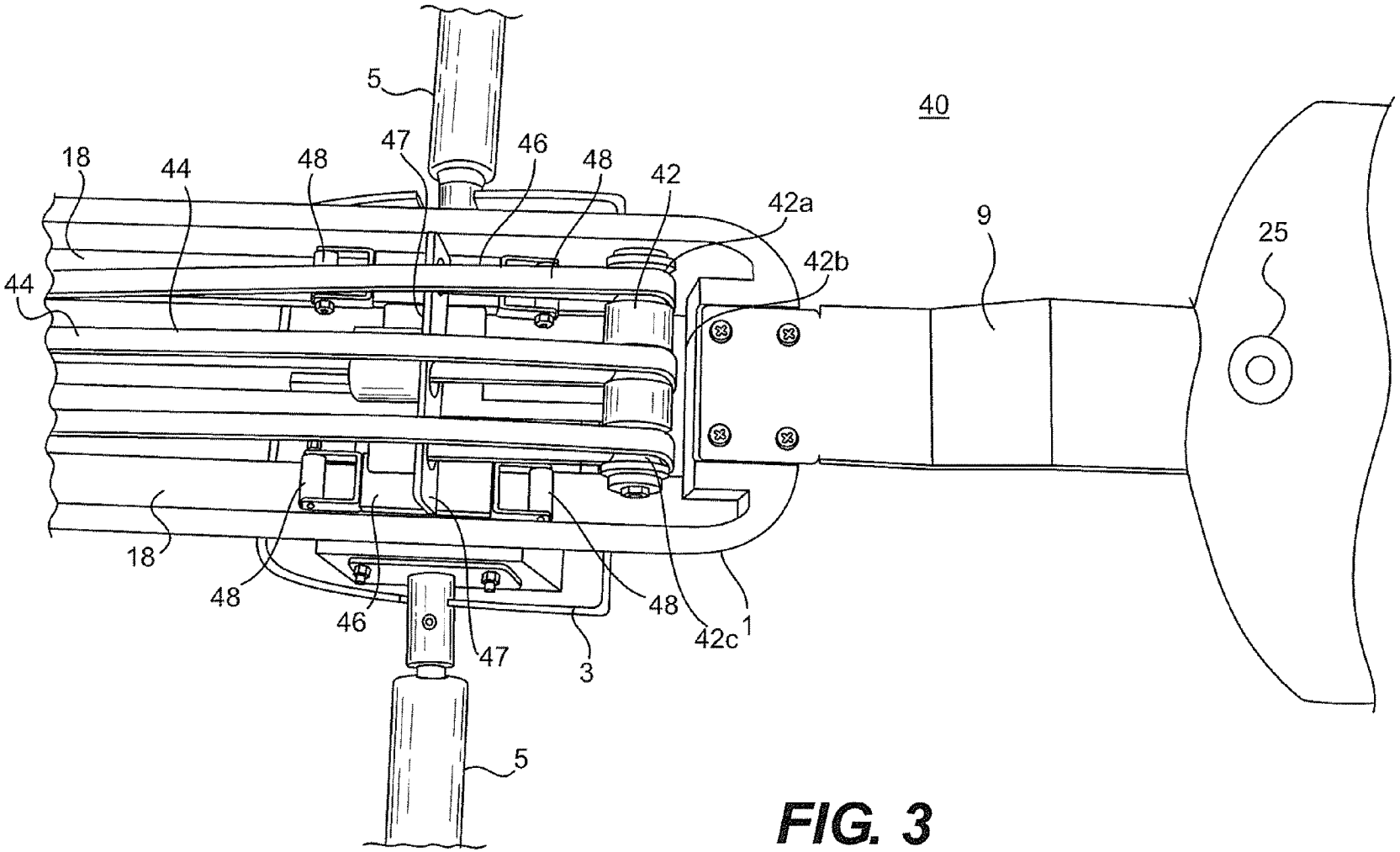
FIG. 3 is a partial bottom view of the embodiment of FIG. 1.

The underside of proximal end 2 of track 1, console 3, beam 9 and stationary base 7 is shown in FIG. 3. Pulley 42 is mounted in proximal end 2 of track 1 and serves as a support or roller bearing for one or more elastic resistance elements 44 which wrap around pulley 42. Pulley 42 includes grooves 42*a*, 42*b* and 42*c* which prevent elastic resistance elements 44 from sliding laterally along pulley 42. Elastic resistance elements 44 each have one end affixed to an anchor point on a console anchor such as anchor plate 47 on undercarriage 46 of console 3. The opposite ends of elastic resistance elements 44 are fixedly anchored to distal end 4 of track 1, in a manner described below. Undercarriage 46 of console 3 is fixedly attached to console 3 in order to facilitate the sliding of console 3 along track 1. As used herein, the term "sliding" shall encompass "rolling" so that console 3 may "slide" along track 1 even if console 3 travels along track 1 on wheels or rollers. For example, undercarriage 46 includes friction mitigation units such as rollers 48, though the friction mitigation units could also be low-friction pads or the like. Undercarriage 46 of console 3 slides along flange 18 of track 1.

Track 1 is rigidly connected to hub 25 of stationary base 7 by beam 9. It is to be understood that the term "rigidly connected" means that track 1 is constrained from displacing laterally relative to hub 25 of stationary base 2 even though track 1 and beam 9 are free to rotate about hub 25, which defines the center of any arcs defined by rotation of track 1. Hub 25 includes a bearing to facilitate rotation of hub 25 and track 1. Thus, a user supported by support surface 21 of stationary base 7 and hand support members 5 of console 3 can rotate track 1 about hub 25 by applying lateral forces to track 1 through console 3.

Figure 4:
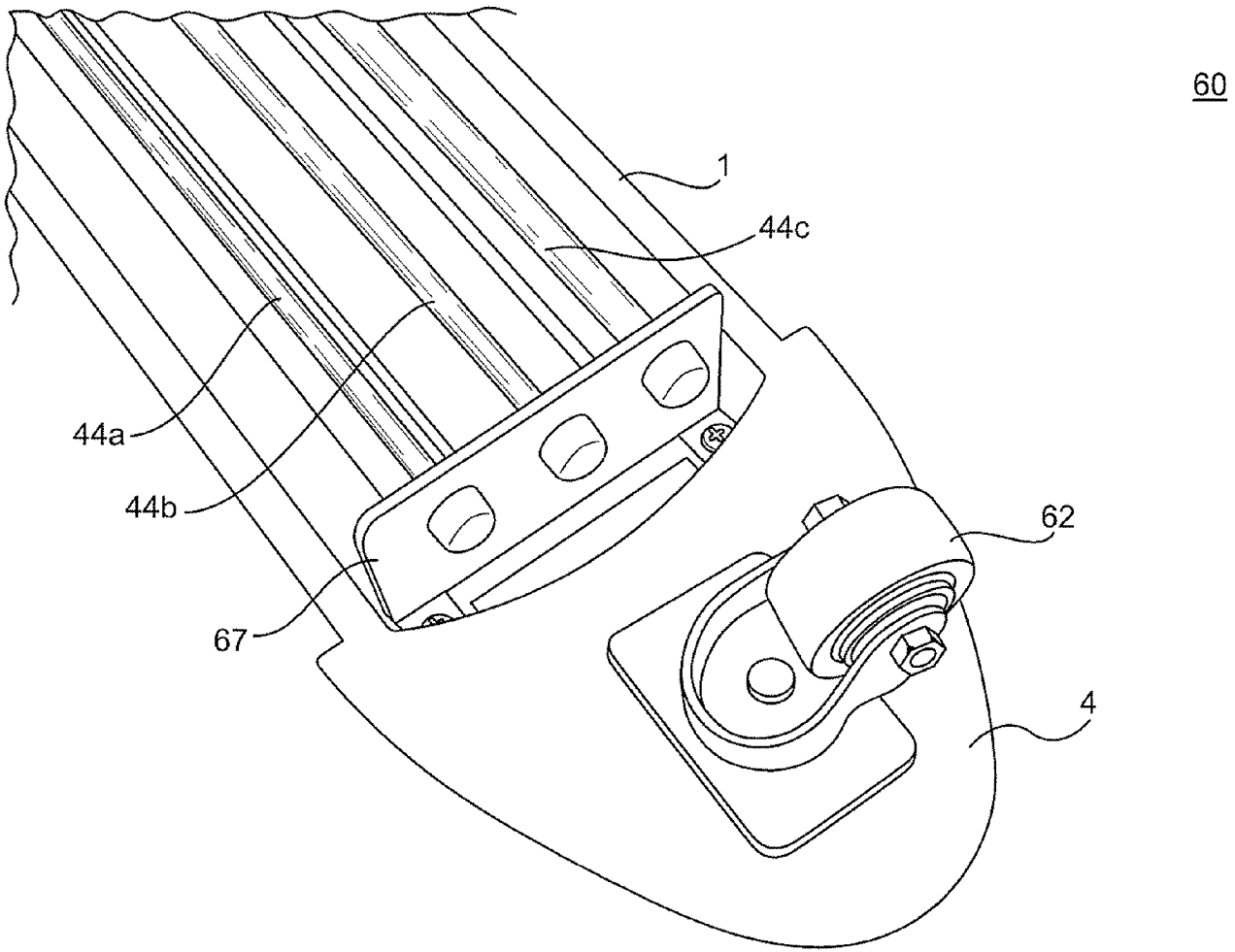
FIG. 4 is a partial bottom view of the distal end of the track portion of the embodiment of FIG. 1.

The underside of distal end 4 of track 1 is shown in FIG. 4. As mentioned above, the opposite ends of elastic resistance elements 44 are anchored to distal end 4 of track 1 at an anchor point on a track anchor such as anchor plate 67. Thus, elastic resistance elements 44 are affixed at opposite ends to anchor plate 47 of console 3 and to anchor plate 67 of track 1, with an interior portion of elastic resistance elements 44 rollably supported by pulley 42. It can thus be seen that movement of console 3 away from proximal end 2 of track 1 and toward distal end 4 causes elastic resistance elements 44 to stretch in length. The force required to stretch elastic resistance elements 44 is provided by the user of abdominal training device 1 by resting upon support surface 21 and hand support members 5 and using the core muscles to push console 3 toward distal end 4 of track 1. Distal end 4 of track 1 also includes a friction mitigation unit such as wheel 62. The friction mitigation unit is provided to facilitate rotation of track 1 about hub 25 and may also be a roller ball or low-friction pad.

Figure 5:
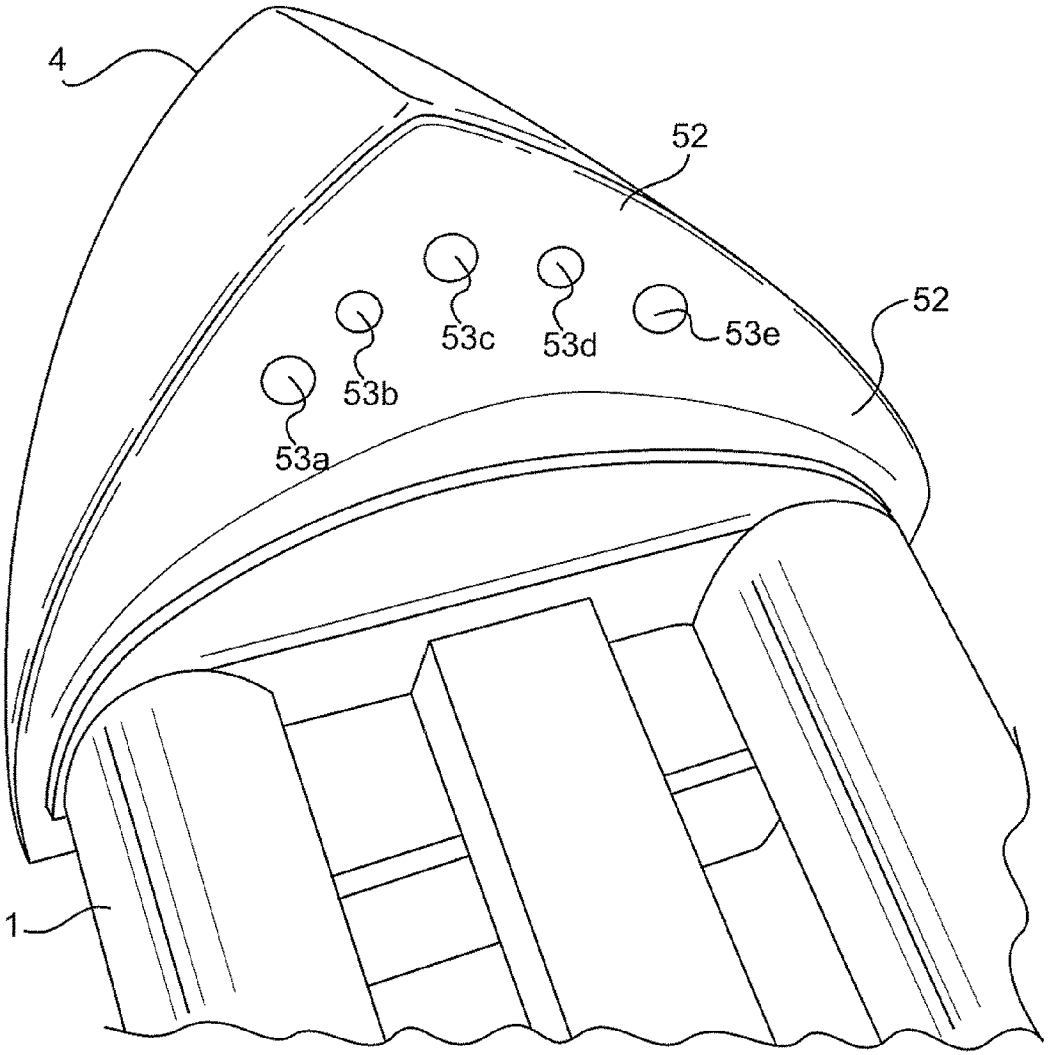
FIG. 5 is a partial top view of the distal end of the track portion of the embodiment of FIG. 1.
Figure 7:
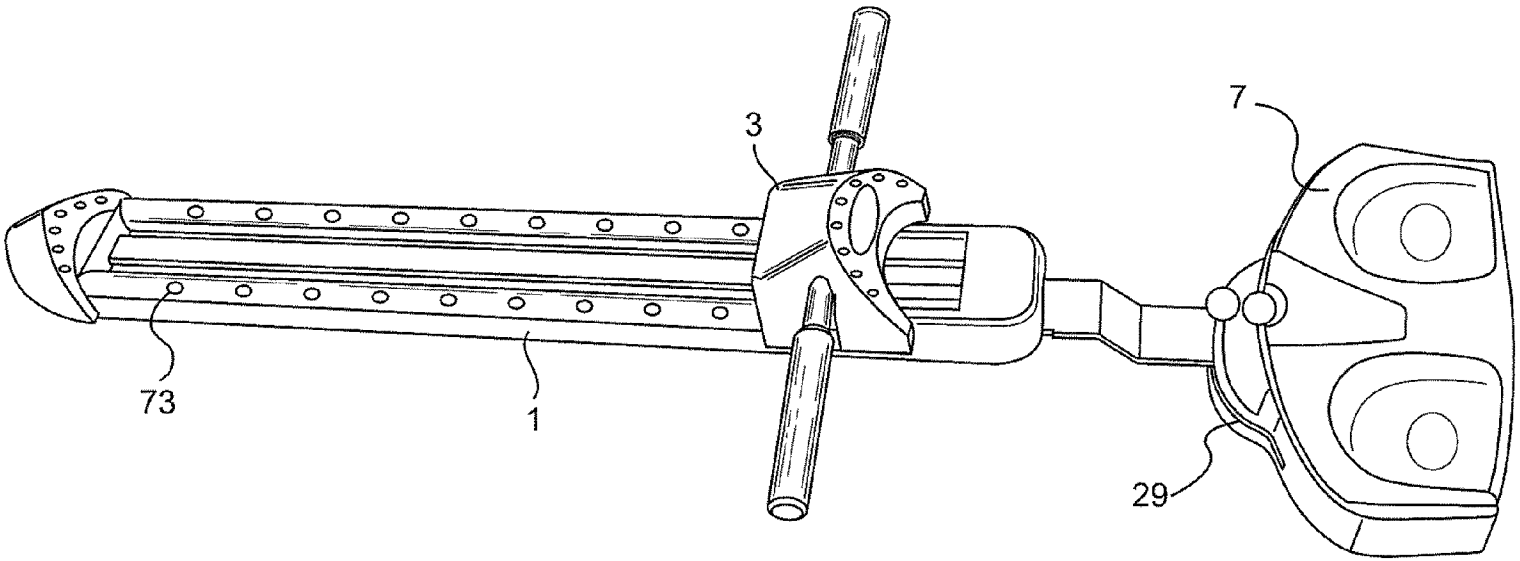
FIG. 7 is a perspective view of an alternative embodiment of an abdominal training device.

The topside of distal end 4 of track 1 is shown in FIG. 5 and includes notification panel 52. A plurality of indicators such as lights 53 are provided on panel 52 so as to be visible to a user supported by support surface 21 and hand support members 5. Similarly, indicators such as lights 33 may be provided on console 3. Finally, as shown in FIG. 7, abdominal training device 10 may also include a plurality of indicators such as lights 73 along the upper surface of track 1. The purpose of lights 53 on panel 52, lights 33 on console 3, and lights 73 on track 1 will be explained below. Notification panel 52 may be removable from track 1. For example, some versions abdominal training device 10 may initially lack notification panel 52 but a user has the ability to install notification panel 52 as desired.

Figure 6:
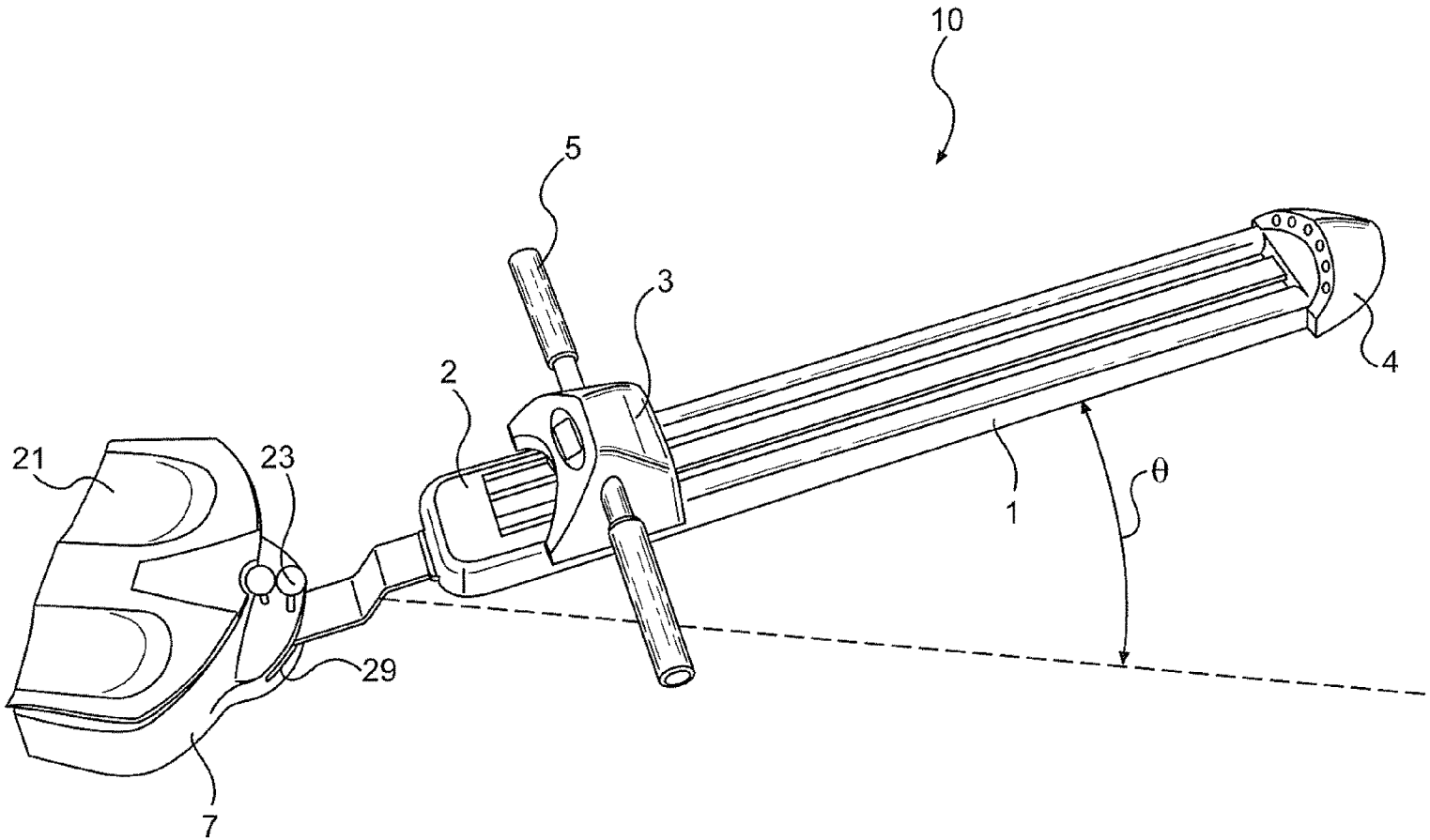
FIG. 6 is a top plan view of the embodiment of FIG. 1, illustrating angular displacement of the track relative to a starting position.

As shown in FIG. 6, track 1 is free to rotate about hub 25 of stationary base 7 when locking mechanism 23 is disengaged. A user of abdominal training device 10 places his knees on support surface 21 of stationary base 7 and his hands on hand support members 5 of console 3. To begin the exercise, the user pushes console 3 forward using core muscles. As console 3 is supported on track 1 by wheels, rollers, or low friction pads, the force applied by the user causes console 3 to slide toward distal end 4 of track 1. This movement of console 3 toward distal end 4 of track 1 causes elastic resistance elements 44 to lengthen. Thus, the user must provide sufficient force to fully stretch elastic resistance elements 44 in order to move console 3 the entire length of the track. The user then pulls back on console 3 and moves back to the starting position with console 3 near proximal end 2 of track 1.

In addition to the motion of console 3 along track 1 described above, the user may also move track 1 from side to side by rotating it about hub 25 of stationary base 7, as shown in FIG. 6. The user can rotate track 1 either before or during the motion of console 3 along track 1. The total available range of motion of track 1 is not critical and can be as high as 360 degrees. However, in the illustrated embodiment, the range of motion of track 1 is approximately 90 degrees (45 degrees both clockwise and counterclockwise from the starting position). Further, the user is free to rotate track 1 less than the total available range of motion (for example, only 15 degrees) in order to add even more variety to the motion of the exercise.

Figure 8:
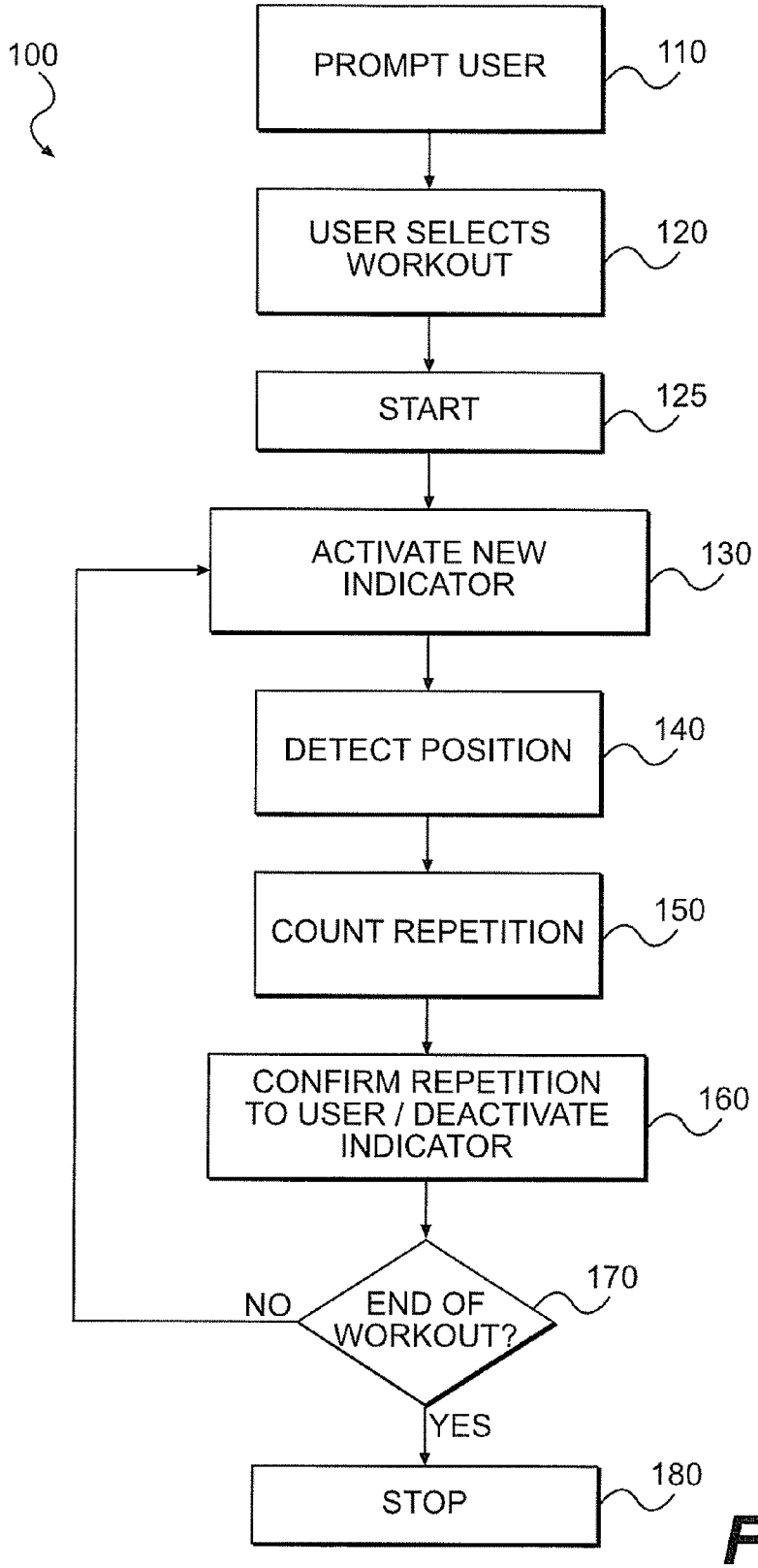
FIG. 8 is a flow chart detailing operation of a training program optionally included in some embodiments of an abdominal training device.

Abdominal training device 10 may also included embedded software, such as training program 100 shown in FIG. 8, stored in non-transitory and tangible computer readable media connected to a processor in console 3. After training program 100 is started by the user, it prompts the user to select a workout (110). This prompt may appear on a display such as display 32 on user interface 31 of console 3. The user then selects a workout (120) using buttons 37 on user interface 31. The program then starts (125) and activates an indicator (130) directing the user to move console 3 and/or track 1 to an indicated position. In this embodiment, the indicators activated by training program 100 are lights or LED's such as lights 33 on console 3, lights 53 on distal end 4 of track 1 and/or lights 73 along the length of track 1. For example, illumination of light 53*a* or 33*a* signifies that the user must rotate track 1 counterclockwise approximately 45 degrees. Similarly, illumination of lights 73 along track 1 indicates to the user how far to move console 3 (to add variety to the exercise routines, the user is not necessarily required to move console 3 all the way to distal end 4 of track 1).

Once the user is notified of the position to which track 1 and/or console 3 must be moved, the user begins performing the required repetition. Abdominal training device 10 then detects when the track 1 and/or console 3 has been moved to the required position (140). This detection may be accomplished by any conventional method, such as embedding magnetic sensors along track 1 that are triggered when console 3 passes by, or embedding magnetic sensors in slit 29 of stationary base 7 that are triggered when beam 9 rotates past. Alternatively, detection of the angle of track 1 relative to the starting position may accomplished by connecting beam 9 to a rheostat inside stationary base 7 so that the electrical resistance in a circuit varies as beam 9 rotates. By measuring the change in resistance, the position of track 1 can be determined.

When training program 100 detects that the user has performed the required movement, it counts one repetition (150) and displays the total number of repetitions performed on display 32. Abdominal training device 10 then confirms to the user that the repetition was successfully performed (160) by deactivating the indicator (for example, light 53*a* or light 33*a*) or by emitting a sound such as a beep from sound generator 34 on user interface 31 of console 3. Training program 100 then determines if the workout is over (170). If the repetition count exceeds a predetermined value (i.e., the most recent repetition was the last repetition of the workout selected by the user), the program ends (180). If more repetitions remain, training program 100 returns to step (130) and activates a new indicator requiring the user to move track 1 and/or console 3 to a new position.

Although in this embodiment of abdominal training device 10 the position of track 1 and/or console 3 is detected using sensors, it is to be understood that in other embodiments no sensors are required. For example, once an indicator is activated directing the user to move track 1 and/or console 3 to a specific position, training program 100 may simply give the user a fixed amount of time such as 5 seconds to perform the repetition before activating the next indicator.

Figure 9:
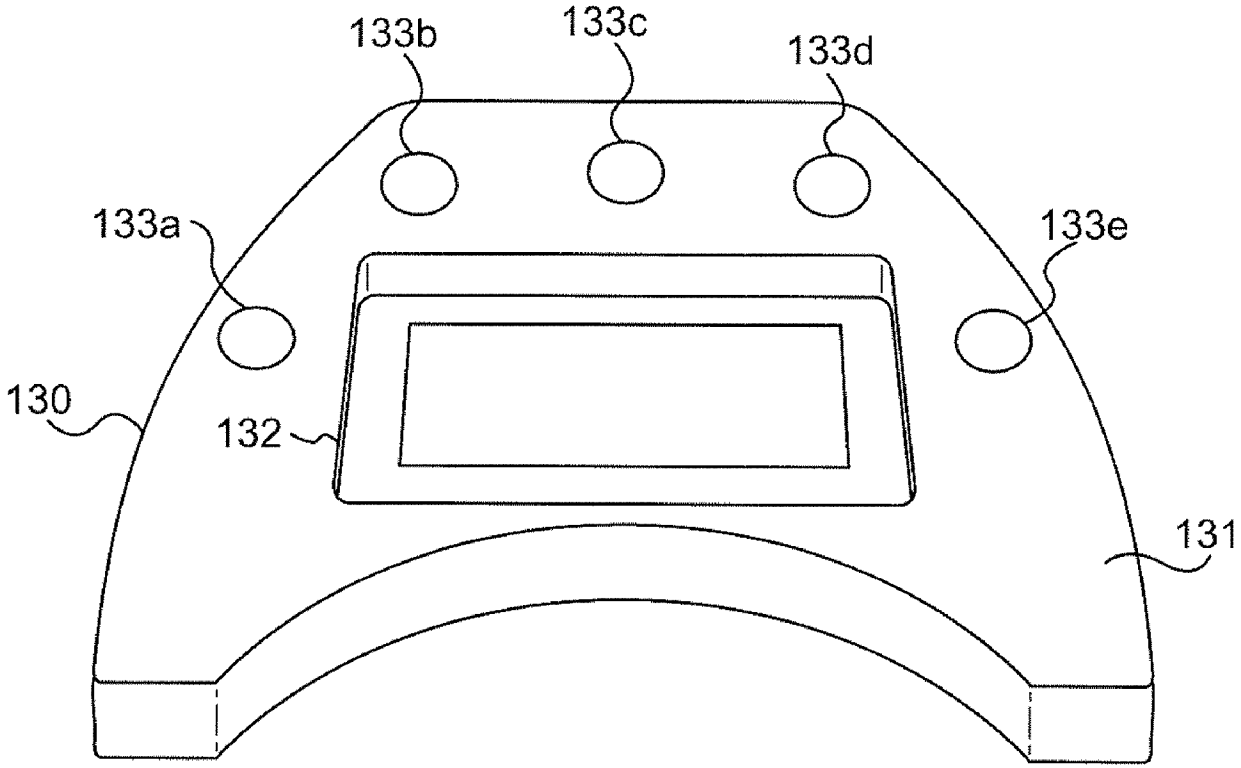
FIG. 9 is a front elevation view of an alternative console for use with the embodiment of FIG. 1.

In another alternative embodiment of abdominal training device 10, the user interface may be a handheld computer such as a smartphone or digital music player. For example, as shown in FIG. 9, console 130 includes computer dock 132. Computer dock 132 may include one or more universal serial bus (USB) ports or one or more ports designed for specific popular handheld devices. In this embodiment, the handheld computer in dock 132 is smartphone 137. Training program 100 is stored in non-transitory and tangible computer readable media on smartphone 137. Thus, smartphone 137 can be used to control and customize the workouts that abdominal training device 10 directs the user to perform.

By incorporating a handheld computer such as smartphone 137 into abdominal training device 10, it is possible to provide richer user interactivity. Smartphone 137 may simply be used to run training program 100 and activate/deactivate lights 133*a*-133*e*, 53*a*-53*e* and 73, but the relatively powerful processors in modern smartphones allows for much more complicated software. For example, a video game that responds to user movements of abdominal training device 10 may be stored on smartphone 137. Furthermore, smartphone 137 may include an accelerometer that measures movement of console 133 and track 1. Smartphone 137 may use data from the accelerometer, instead of sensors built into abdominal training device 10, to determine whether the user has performed movements as required by training program 100. Finally, smartphone 137 may communicate with another computer or video game console wirelessly. If so, a computer monitor or television screen can be used to display a video game that responds to movements of abdominal training device 10. As desktop computers and video game consoles can have much more powerful processors than are found in handheld computers, the interactive user experience may be even richer.

Figure 10:
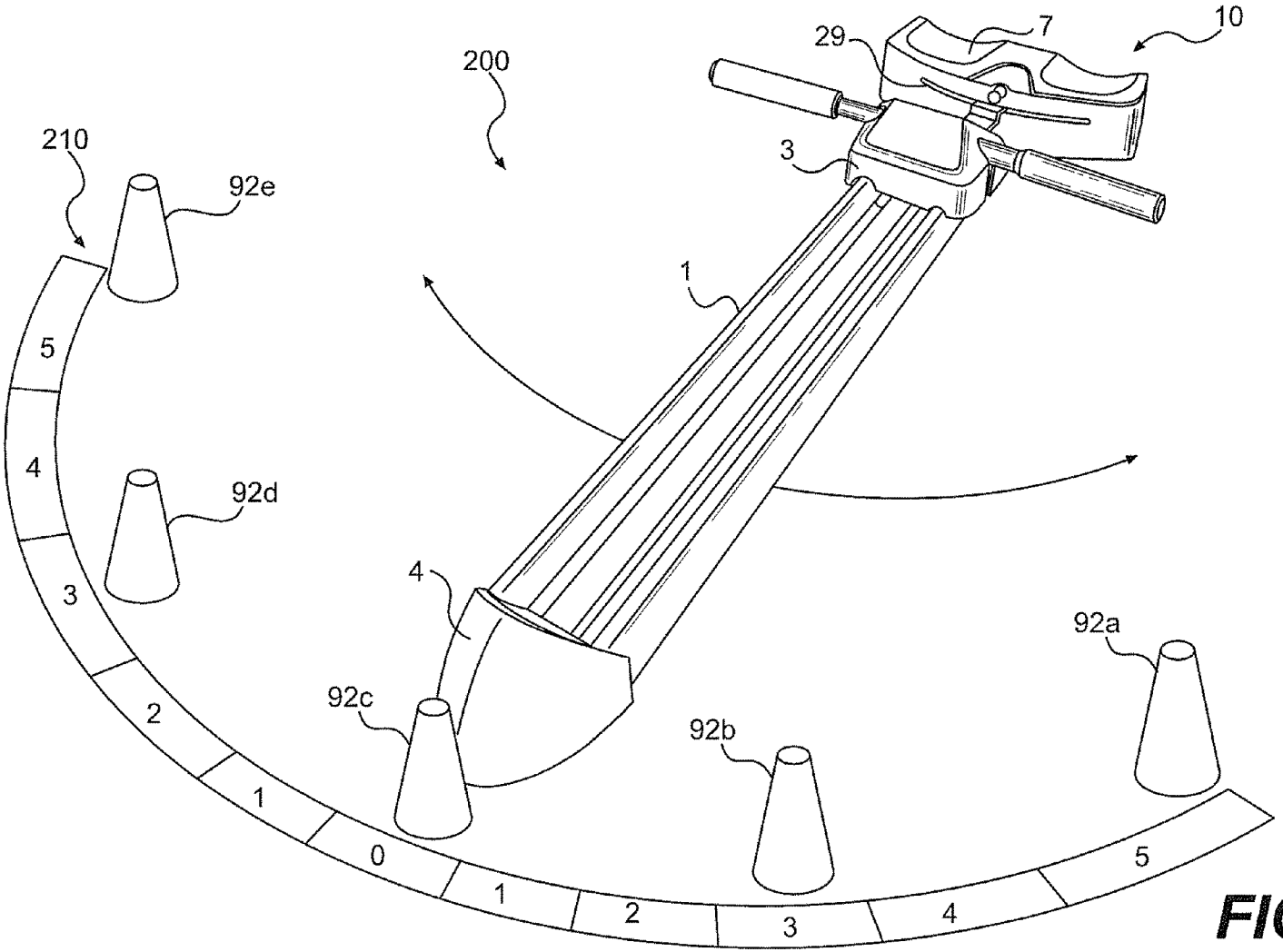
FIG. 10 is a perspective view of one embodiment of an abdominal training kit including an abdominal training device and a rotation measurement device.

An abdominal training kit 200 including abdominal training device 10 and rotation measurement device 210 is shown in FIG. 10. Rotation measurement device 210 is used as an alternative to, or in addition to, training program 100 and indicator lights 33 and 53. In this embodiment, rotation measurement device 210 includes a plurality of cones 92 and arcuate mat 94 which is provided with indicia corresponding to the rotation of track 1 relative to the starting position (shown as 0 on arcuate mat 94). The user can then use rotation measurement device 210 to help perform repetitions on abdominal training device 10 in various desired directions.

Figure 11:
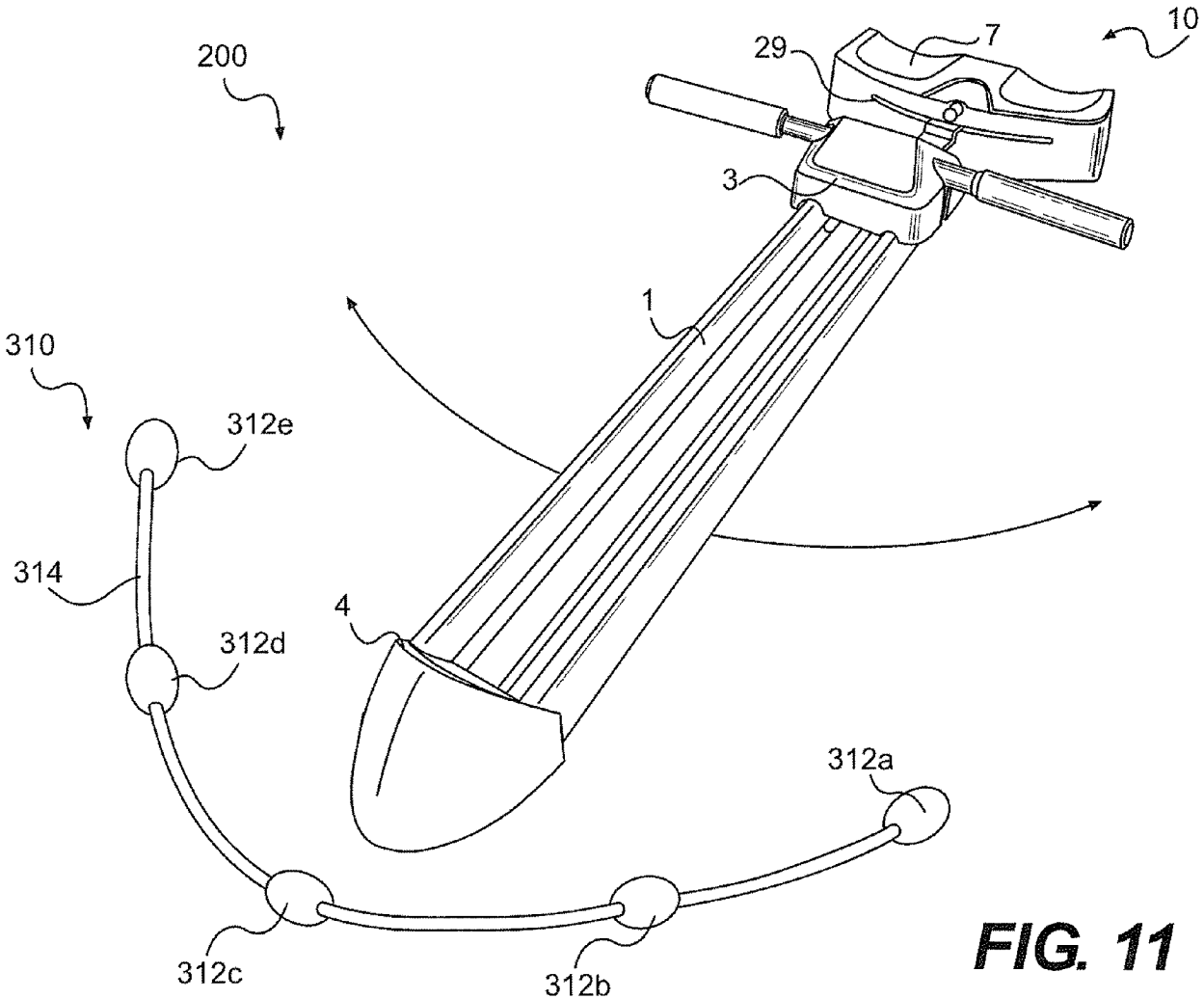
FIG. 11 is a perspective view of another embodiment of an abdominal training kit including an abdominal training device and a rotation measurement device.

FIG. 11 shows alternative abdominal training kit 200 with an alternative rotation measurement device 310. In this embodiment, rotation measurement device 310 includes a plurality of indicators 312 on an arcuate strand 314. Indicators 312 may be lights that illuminate and extinguish according to a predetermined pattern. The user can then rotate track 1 to align with each illuminated indicator 312 in order to perform a workout routine.

The materials used to construct abdominal training device 10 and abdominal training kit 200 are not critical. Most portions of track 1, console 3 and stationary base 7 may be made from a wide variety of plastics such as polypropylene, polystyrene, polyvinylchloride, etc. Some portions of track 1, console 3 and stationary base 7 may be made from metals for increased durability and strength. For example, undercarriage 46 of console 3 may be partially made from metal to withstand the weight of the user. Similarly, beam 9 may be made of metal to withstand stresses caused by the user performing exercises.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An abdominal training device, comprising:

a stationary base comprising a user support surface and a hub;

a track having a proximal end and a distal end with at least one track anchor, the track comprising a friction mitigation unit;

a console slidably mounted on the track, the console comprising at least one hand support member and at least one console anchor;

a bearing fixedly mounted to the proximal end of the track;

at least one elastic resistance element supported by the bearing, the elastic resistance element having a first end attached to the track anchor and a second end attached to the console anchor; and a beam rigidly connecting the track to the hub of the stationary base, the beam having a first end attached to the proximal end of the track and a second end attached to the hub of the stationary base;

wherein the track is at least partially rotatable about the hub of the stationary base.

2. The abdominal training device of claim 1, wherein the bearing is a pulley.

3. The abdominal training device of claim 1, wherein the hand support member is a pair of handlebars.

4. The abdominal training device of claim 1, wherein the friction mitigation unit is a wheel.

5. The abdominal training device of claim 1, wherein the elastic resistance element is one of a plurality of elastic resistance elements supported by the bearing, each elastic resistance element having a first end attached to the track anchor and a second end attached to the console anchor.

6. The abdominal training device of claim 1, wherein the track has a range of rotation of at least 90 degrees.

7. The abdominal training device of claim 1, further comprising a track position sensor that detects a current displacement of the track relative to a starting position.

8. The abdominal training device of claim 7, further comprising an alert system that indicates the current displacement of the track to a user of the abdominal training device.

9. The abdominal training device of claim 8, wherein the alert system comprises lights that illuminate or extinguish when the current displacement of the track exceeds a threshold displacement.

10. The abdominal training device of claim 8, wherein the alert system comprises a sound generator that emits a sound when the current displacement of the track exceeds a threshold displacement.

11. The abdominal training device of claim 7, further comprising a console position sensor that detects a current position of the console relative to the track.

12. The abdominal training device of claim 7, further comprising an electronic training program stored on the abdominal training device that uses data received from the track position sensor to direct a user of the abdominal training device to rotate the track from a current position to a new position.

13. The abdominal training device of claim 12, wherein the new position of the track is indicated to the user by illumination of a light corresponding to the new position.

14. The abdominal training device of claim 13, wherein the light extinguishes after the user rotates the track to the new position.

15. The abdominal training device of claim 13, further comprising a sound generator that emits a sound after the user rotates the track to the new position.

16. The abdominal training device of claim 13, wherein the electronic training program is stored on a user interface panel detachable from the console.

17. The abdominal training device of claim 13, further comprising a handheld computer dock, wherein the electronic training program is stored on a handheld computer connected to the handheld computer dock of the abdominal training device.

18. The abdominal training device of claim 17, wherein the handheld computer is a smartphone.

19. An abdominal training kit, comprising:

an abdominal training device, comprising:

a stationary base comprising a user support surface and a hub;

a track having a proximal end and a distal end, the track comprising a friction mitigation unit;

a console slidably mounted on the track, the console comprising a hand support member; and a beam rigidly connecting the track to the stationary base, the beam having a first end attached to the proximal end of the track and a second end attached to the hub of the stationary base;

wherein the track is at least partially rotatable about the hub of the stationary base; and a rotation measurement device comprising a plurality of evenly spaced indicators disposed around the hub of the abdominal training device, the plurality of evenly spaced indicators defining an arc.

20. The abdominal training kit of claim 19, wherein the arc defined by the plurality of evenly spaced indicators is at least 45 degrees.

21. The abdominal training kit of claim 19, wherein the rotation measurement device is an arcuate mat and wherein the plurality of evenly spaced indicators comprises a plurality of evenly spaced indicia on the mat.

22. The abdominal training kit of claim 19, wherein the plurality of evenly spaced indicators comprises a plurality of evenly spaced cones.

23. The abdominal training device of claim 19, wherein the plurality of evenly spaced indicators are lights on a strand.

* * * * *